US009721457B2

(12) United States Patent
Thompson et al.

(10) Patent No.: US 9,721,457 B2
(45) **Date of Patent: *Aug. 1, 2017**

(54) GLOBAL POSITIONING SYSTEM EQUIPPED WITH HAZARD DETECTOR AND A SYSTEM FOR PROVIDING HAZARD ALERTS THEREBY

(71) Applicants: Jonathan Thompson, Los Angeles, CA (US); Latonya Slack, Los Angeles, CA (US)

(72) Inventors: Jonathan Thompson, Los Angeles, CA (US); Latonya Slack, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/012,779

(22) Filed: Feb. 1, 2016

(65) Prior Publication Data

US 2016/0163184 A1 Jun. 9, 2016

Related U.S. Application Data

(63) Continuation of application No. 13/866,227, filed on Apr. 19, 2013, now Pat. No. 9,251,687.

(51) Int. Cl.

| | |
|---|---|
| ***G08B 27/00*** | (2006.01) |
| ***G08B 21/14*** | (2006.01) |
| ***G08B 17/10*** | (2006.01) |
| ***G08B 21/10*** | (2006.01) |
| ***G08B 21/12*** | (2006.01) |
| ***G08B 21/18*** | (2006.01) |
| *G08B 25/14* | (2006.01) |

(52) U.S. Cl.

CPC ..... *G08B 27/00* (2013.01); *G08B 17/10* (2013.01); *G08B 21/10* (2013.01); *G08B 21/12* (2013.01); *G08B 21/14* (2013.01); *G08B 21/182* (2013.01); *G08B 25/14* (2013.01)

(58) Field of Classification Search

CPC ..... G08B 17/10; G08B 21/10; G08B 21/12; G08B 21/14; G08B 21/18; G08B 21/182; G08B 25/10; G08B 25/14; G08B 27/00; G08B 29/04; H04L 12/2803

USPC ..... 340/521, 522, 539.22, 600, 604, 628

See application file for complete search history.

(56) References Cited

U.S. PATENT DOCUMENTS

| | | | | |
|---|---|---|---|---|
| 5,461,365 | A | 10/1995 | Schlager et al. | |
| 5,650,770 | A | 7/1997 | Schlager et al. | |
| 6,028,514 | A | 2/2000 | Lemelson et al. | |
| 6,031,455 | A * | 2/2000 | Grube | G01W 1/04 340/13.24 |
| 6,552,647 | B1 | 4/2003 | Thiessen et al. | |
| 7,027,808 | B2 | 4/2006 | Wesby | |
| 7,301,455 | B2 | 11/2007 | McKenna et al. | |
| 8,624,771 | B2 | 1/2014 | Kuhn | |

(Continued)

*Primary Examiner* — Quan-Zhen Wang
*Assistant Examiner* — Stephen Burgdorf
(74) *Attorney, Agent, or Firm* — Hankin Patent Law, APC; Kevin Schraven; Anooj Patel

(57) ABSTRACT

The present invention relates to detectors of hazardous environmental conditions (e.g., smoke, gas, motion). Specifically, the invention relates to a hazard detector configured to transmit and/or receive information related to hazardous environmental conditions based at least in part on the location of the hazard detector as identified through one or more location based service means (e.g., global positioning systems (GPS), cellular triangulation, Internet IP geolocation).

7 Claims, 4 Drawing Sheets

(56) References Cited

U.S. PATENT DOCUMENTS

| | | | | |
|---|---|---|---|---|
| 8,830,057 | B1 | 9/2014 | Poursohi et al. | |
| 2003/0234725 | A1* | 12/2003 | Lemelson | G08B 7/066 340/521 |
| 2004/0203568 | A1* | 10/2004 | Kirtland | G08B 27/006 455/404.1 |
| 2004/0263338 | A1 | 12/2004 | Katz | |
| 2005/0162267 | A1* | 7/2005 | Khandelwal | G08B 27/005 340/506 |
| 2007/0008104 | A1 | 1/2007 | McBain | |
| 2007/0139183 | A1 | 6/2007 | Kates | |
| 2009/0170467 | A1 | 7/2009 | Nowlan et al. | |
| 2009/0219152 | A1 | 9/2009 | Angelo et al. | |
| 2009/0251312 | A1 | 10/2009 | Shelton et al. | |
| 2009/0322523 | A1 | 12/2009 | McKenna et al. | |
| 2010/0020166 | A1 | 1/2010 | Levine et al. | |
| 2011/0012753 | A1 | 1/2011 | Shrum | |
| 2012/0194334 | A1 | 8/2012 | Worthington et al. | |
| 2012/0326889 | A1 | 12/2012 | Kabler et al. | |
| 2013/0241727 | A1* | 9/2013 | Coulombe | G08B 23/00 340/517 |
| 2013/0335550 | A1* | 12/2013 | Rochenski | G08B 17/125 348/82 |
| 2014/0031082 | A1 | 1/2014 | Zishaan | |

* cited by examiner

GLOBAL POSITIONING SYSTEM EQUIPPED WITH HAZARD DETECTOR AND A SYSTEM FOR PROVIDING HAZARD ALERTS THEREBY

CROSS-REFERENCE TO RELATED APPLICATIONS

This application is a continuation of U.S. patent application Ser. No. 13/866,277 filed Apr. 19, 2013, entitled "Global Positioning System Equipped Hazard Detector and a System for Providing Hazard Alerts thereby" all of which is hereby incorporated by reference is if fully set forth herein.

FIELD

The present invention relates to detectors of hazardous environmental conditions (e.g., smoke, gas, motion). Specifically, the invention relates to a hazard detector configured to transmit and/or receive information related to hazardous environmental conditions based at least in part on the location of the hazard detector as identified through one or more location based service means (e.g., global positioning systems (GPS), cellular triangulation, Internet IP geolocation).

BACKGROUND

In many cases, during a natural disaster, loss of life and bodily harm can be attributed to lack of appropriate early warning systems. With early detection and warning, individuals can prepare for impending disasters and take appropriate actions needed to mitigate loss of life and damage to property.

By and large, most individuals rely on emergency broadcast systems to receive early warning and reports of impending natural disasters or other hazardous environmental conditions. However, it is rare that an individual, or even a group of individuals, has constant access to such emergency broadcast systems. In general, these systems are provided over some form of electronic medium (e.g., television, radio, Internet), all of which must be actually turned on or otherwise engaged for the device to receive the emergency broadcast signal.

Further, since emergency broadcast systems are generally indiscriminate as to location, it may be hard for an individual to know whether they are in danger with regards to any specific emergency broadcast. For instance, an emergency broadcast could be sent out over all available mediums (e.g., television, radio, Internet) for an emergency that only affects or potentially affects a portion of the communities served by the emergency broadcast. In this example, public panic could be caused in areas not affected by the current or pending hazard.

Additionally, all emergency broadcast systems are currently based on the concept of a central broadcasting system receiving an alert from a single source (e.g., government agency) and then broadcasting that alert to everyone in a listening/viewing area. The recipient of the broadcast has no means to interact with the alert system nor does it have the ability to provide real-time updates as to whether the broadcast is relevant to the specific area of the recipient or whether the recipient needs additional support (e.g., medical, fire, rescue) in response to the emergency.

Therefore, there is a need in the art for a hazard detection and alert device capable of alerting individuals of impending dangers based on their specific location. These and other features and advantages of the present invention will be explained and will become obvious to one skilled in the art through the summary of the invention that follows.

SUMMARY

The present invention provides a hazard detection and alert device capable of alerting individuals of impending dangers based on their specific location. In a preferred embodiment, the hazard detector is configured to provide alerts to homeowners or other individuals in possession of the hazard detector using location based systems in order to verify accuracy and applicability of specific hazard reports.

According to an embodiment of the present invention, a hazard detector includes: a geolocation means configured to identify a geographic location of the hazard detector; a communication means configured to transmit the geographic location of the hazard detector and receive hazard alerts from a remote hazard detection and alert system; and an alert means configured to provide a perceptible alert to individuals in the proximity of the hazard detector.

According to an embodiment of the present invention, the geolocation means is a global positioning system means.

According to an embodiment of the present invention, the geolocation means is a cellular positioning means.

According to an embodiment of the present invention, the alert means is one or more alert means selected from the group comprising, speakers, video displays, LEDs, warning lights, strobe lights, force feedback devices, electro stimulation devices and tone generators.

According to an embodiment of the present invention, the communications means is selected from the group comprising a satellite communications means, a cellular communications means and a wired communications means.

According to an embodiment of the present invention, the hazard detector includes one or more power sources selected from the group comprising an AC power source, a DC power source, a battery powered power source, and a solar power source.

According to an embodiment of the present invention, the hazard detector includes a hazard detection means configured to detect the presence of one or more types of hazards.

According to an embodiment of the present invention, the hazard detection means is selected from the group comprising a smoke detector, a carbon monoxide detector, a heat detector, a motion sensor, a video camera, a glass break sensor, a microphone, a Geiger counter and a water sensor.

According to an embodiment of the present invention, the communications means is further configured to transmit information about a detected hazard to said remote hazard detection and alert system.

According to an embodiment of the present invention, a method for providing hazard detection includes the steps of: receiving a hazard alert at a remote hazard detection and alert system; identifying a geographic location of said hazard alert; retrieving a list comprising identifiers for one or more hazard detectors in said geographic location; and transmitting an alert to said one or more hazard detectors, based at least in part on said hazard alert.

According to an embodiment of the present invention, the hazard alert is received from a third party alert system.

According to an embodiment of the present invention, the hazard alert is received from a first hazard detector.

According to an embodiment of the present invention, the geographic location comprises a geographic area impacted by said hazard alert.

According to an embodiment of the present invention, the method further includes the step of generating alerts at each of said one or more hazard detectors.

According to an embodiment of the present invention, the alerts are perceptible to individuals in the proximity of the one or more hazard detectors According to an embodiment of the present invention, the method includes the step of receiving a response from one or more of said one or more hazard detectors at said remote hazard detection and alert system.

According to an embodiment of the present invention, the response is a request for emergency assistance.

The hazard detector system may further comprise at least one visually perceptible alert means and/or at least one audibly perceptible alert means configured to provide alerts in sequence(s) to inform the individual(s) in the proximity of the type, nature, and/or severity of the hazardous environmental condition(s).

The hazard detector system of claim 7, wherein the alert means comprises at least one visually perceptible alert means of different color(s), sequences, and luminous intensity based on said hazard alert type, nature, and/or severity of the hazardous environmental condition(s) and/or at least one audibly perceptible alert means of varying decibel intensity based on said hazard alert type, nature, and/or severity of the hazardous environmental condition(s).

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED DESCRIPTION

Figure 1:
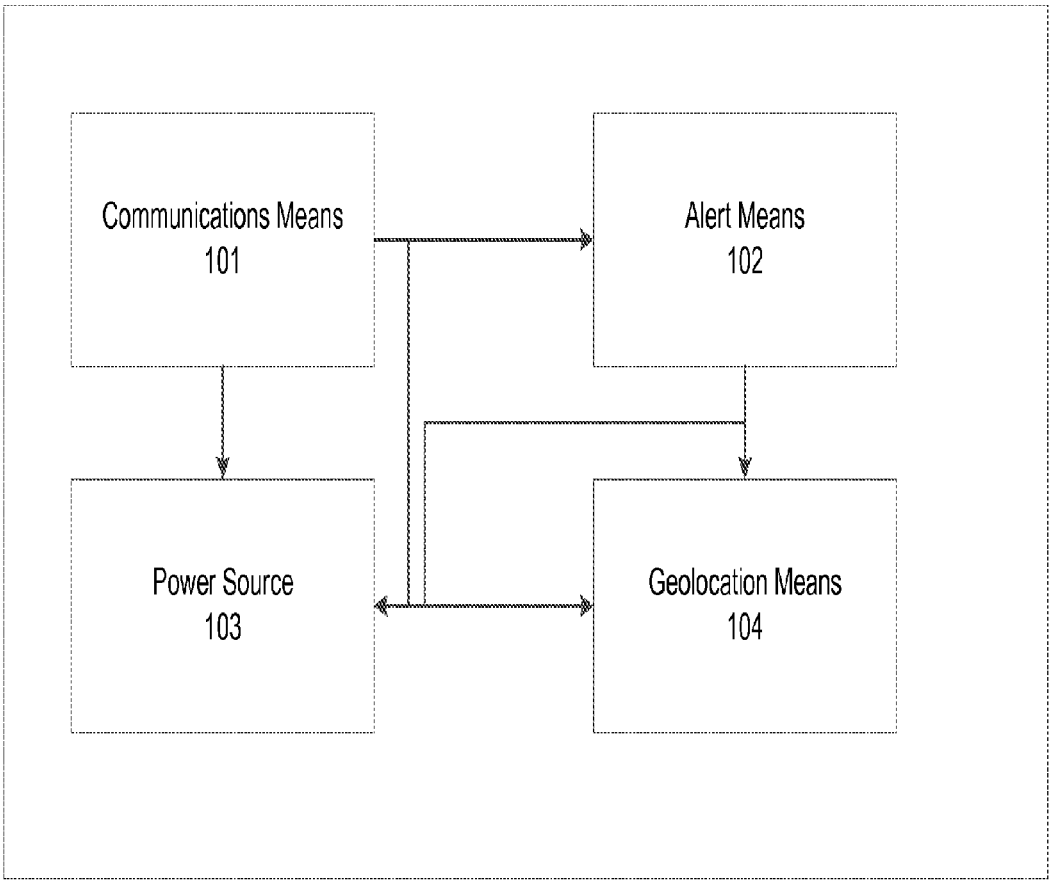
FIG. 1 is a diagram of a hazard detector in accordance with an embodiment of the present invention.

The present invention relates to detectors of hazardous environmental conditions (e.g., smoke, gas, motion). Specifically, the invention relates to a hazard detector configured to transmit and/or receive information related to hazardous environmental conditions based at least in part on the location of the hazard detector as identified through one or more location based service means (e.g., global positioning systems (GPS), cellular triangulation, Internet IP geolocation).

According to preferred embodiments of the present invention, the hazard detector of the present invention may be connected wirelessly to one or more remote computing devices for the provision of certain services related to the detection of hazards and alerting individuals to such hazards. Wireless communication means utilized with embodiments of the present invention may include, but are not limited to, satellite communication systems, cellular communication systems (e.g., 3G, 4G, LTE, CDMA, GSM), wireless Internet communications means (e.g., WIFI). One of ordinary skill in the art would appreciate that there are numerous types of wireless communications means that could be utilized with embodiments of the present invention, and embodiments of the present invention are contemplated for use with any form of wireless communications means. Further, in certain embodiments, wired communications means, such as Ethernet cables, telephone cables, CAT 5E, CAT 6 or any combination thereof, may be utilized in conjunction with or in lieu of one or more wireless communications means. One of ordinary skill in the art would appreciate that there are numerous wired communications means and combinations of wireless and wired communications means that could be utilized with embodiments of the present invention, and embodiments of the present invention are contemplated for use with any communication means.

One of ordinary skill in the art would appreciate that computing device appropriate for use with embodiments of the present application may generally be comprised of one or more of a Central processing Unit (CPU), Random Access Memory (RAM), and a storage medium (e.g., hard disk drive, solid state drive, flash memory, cloud storage). Examples of computing devices usable with embodiments of the present invention include, but are not limited to, personal computers, smart phones, laptops, mobile computing devices, tablet PCs and servers. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In an exemplary embodiment according to the present invention, data may be provided to the system, stored by the system and provided by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs and configured to transmit and/or receive information from one or more hazard detectors communicatively connected to the servers. One of ordinary skill in the art would appreciate that there are numerous manners in which the system could be configured and embodiments of the present invention are contemplated for use with any configuration.

Turning now to FIG. 1, an exemplary embodiment of a hazard detector is shown. In this embodiment, a hazard detector is comprised of a communications means 101, an alert means 102, a power source 103 and a geolocation means 104. In this embodiment, the hazard detector is configured to receive hazard alerts from a remote computing system based on the location of the hazard detector as noted by its internal geolocation means 104. In certain embodiments, the hazard detector may be configured to receive alerts from the system and determine whether an alert applies to the particular hazard detector based on the location of the hazard detector as determined by the geolocation means 104. In other embodiments, the hazard detector may be configured to transmit its location (as determined by the geolocation means 104) to a remote computing system and the remote computing system will then transmit alerts to the hazard detector based on the provided location.

According to an embodiment of the present invention, the communications means 101 of the hazard detector may be any wireless communication means, wired communications means, or any combination thereof (as noted above). In some embodiments of the present invention, the communications means 101 of the hazard detector may be configured to only receive data communications from a remote computing system. In these embodiments, processing of the information associated with the data received will be handled in the hazard detector. In preferred embodiments of the present invention, the communications means 101 is configured to transmit and receive data from the remote computing system. In these embodiments, processing of the information associated with the data may be performed on the remote computing system, on the hazard detector, or any combination thereof.

According to an embodiment of the present invention, the alert means 102 of the hazard detector may be comprised of one or more components configured to provide perceptible alerts to one or more individuals. Alert means may include, but are not limited to, audible indicators, visual indicators, tactile indicators or any combination thereof. Audible indicators may include, but are not limited to, sirens, beep generators, voice playback devices or any combination thereof. Visual indicators may include, but are not limited to, strobe lights, flashing lights, LEDs, flood lights, display screens, solid display lights, illumination devices, or any combination thereof. Tactile indicators may include, but are not limited to force feedback devices, electro-stimulation devices and other tactile sensory stimulation devices. A hazard detector may include one or more types of alert means. One of ordinary skill in the art would appreciate that there are numerous types of alert means and combinations of alert means that could be utilized with embodiments of the present invention, and embodiments of the present invention are contemplated for use with any type of alert means or combination of alert means.

According to an embodiment of the present invention, the power source 103 of the hazard detector may include, but are not limited to batteries, AC power supplies, DC power supplies, rechargeable power means (e.g., solar power panels with battery backup means) or any combination thereof. One of ordinary skill in the art would appreciate that there are numerous types of power sources that could be utilized with embodiments of the present invention, and embodiments of the present invention are contemplated for use with any type of power source. In a preferred embodiment, the power source would comprise at least one source of power that is self-contained (e.g., battery backup) so that if power transmission means in the area are downed or otherwise disabled, the hazard detector can continue to operate on its own backup power.

According to an embodiment of the present invention, the geolocation means 104 of the hazard detector is configured to identify the location of the hazard detector. Geolocation means 204 may include, but are not limited to, GPS systems, cellular location systems (e.g., triangulation), IP address geolocation means, or any combination thereof. One of ordinary skill in the art would appreciate that there are numerous geolocation means that could be utilized with embodiments of the present invention, and embodiments of the present invention are contemplated for use with any geolocation means. Further, certain embodiments of the present invention may include a plurality of geolocation means. In this manner, if one form of geolocation means was unavailable (e.g., GPS unable to get signal) a secondary geolocation means could be utilized (e.g., IP address geolocation). Additionally, the geolocation means 104 may include secondary location components allowing for detailed location information, such as altitude and positioning (e.g., level, degree of tilt). One of ordinary skill in the art would appreciate that there are numerous types of secondary location components (e.g., accelerometer, levels, altimeters) that may be utilized with embodiments of the present invention, and embodiments of the present invention are contemplated for use with any such secondary location components.

Figure 2:
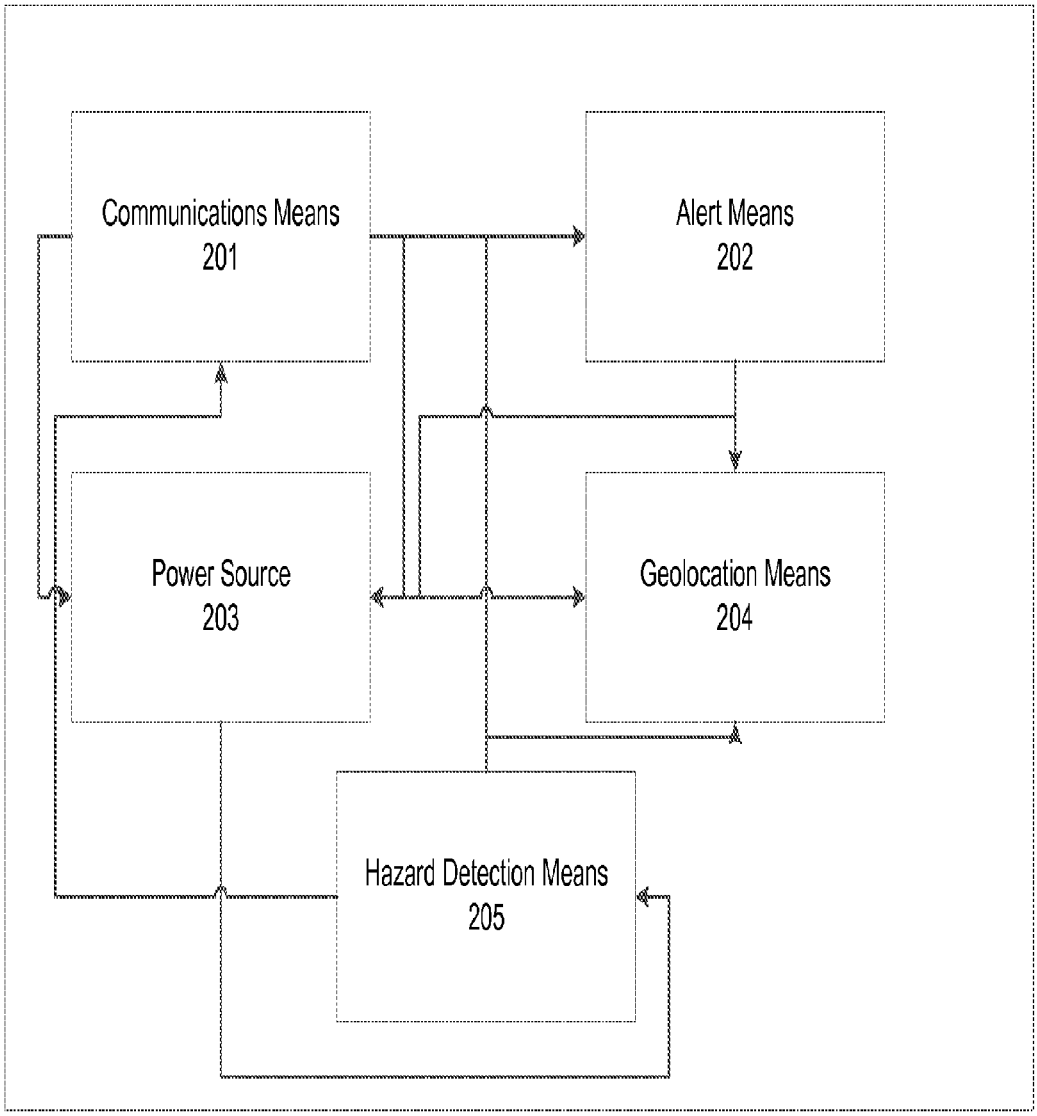
FIG. 2 is a diagram of a hazard detector with transmission capabilities in accordance with an embodiment of the present invention.

Turning now to FIG. 2 an exemplary embodiment of a hazard detector is shown. In this embodiment, a hazard detector is comprised of a communications means 201, an alert means 202, a power source 203 a geolocation means 204 and a hazard detection means 205. The communications means 201, alert means 202, power source 203 and geolocation means 204 are similar in like and kind with those described above with respect to the embodiment shown in FIG. 1.

According to an embodiment of the present invention, the hazard detection means 205 of a hazard detector is configured to detect one or more environment hazard or other type of hazard. Hazard detection means 205, may include, but is not limited to, one or more of a carbon monoxide detector, a smoke detector, a heat detector, a water detector, a motion detector, a glass break detector a video camera, an audio recording device or any combination thereof. One of ordinary skill in the art would appreciate that there are numerous types of hazard detection means that could be utilized with embodiments of the present invention, and embodiments of the present invention are contemplated for use with any number and kind of hazard detection means.

In embodiments of the present invention where the hazard detector includes a hazard detection means, the hazard detector is configured to not only receive emergency alerts, but it is also configured to detect local hazards. By detecting local hazards, the hazard detector may work in conjunction with the remote computing system to provide additional functionality. For instance, if there is an ongoing alert for a wildfire in the area of the hazard detector, and a hazard detection means on the hazard detector detects an increase in heat or the presence of smoke, the hazard detector could both confirm the presence of the hazard to individuals in the immediate vicinity, but could also provide information to the remote computing system about the veracity of the impending hazard. In embodiments where a voice audio playback alert or video alert means is provided, the hazard detector could alert the individuals in the immediate vicinity of the confirmation of a pending or present hazard and any associated information. For instance, information could be provided regarding appropriate escape routes, time until rescue, medical or other emergency personnel will arrive, or information about how to best mitigate harmful environmental effects (e.g., putting wet rags over mouth and nose in the presence of smoke).

In certain embodiments, the hazard detector can be fixed, such as installed on a home (e.g., similar to a smoke detector, alarm system, or thermostat). In other embodiments, the hazard detector may be portable. In still further embodiments, the hazard detector may be extremely portable or wearable on an individual (e.g., a watch, a badge, a handheld device).

In certain embodiments of the present invention, hazard detectors may be made from materials and/or components that are resistant to various elements. For instance, certain embodiments of the present invention may be made from water resistant or waterproof materials where the risk of water damage is present. Other embodiments may be made from materials with properties such as shock resistant, fire resistant, resistant to electromagnetic pulses, resistant to bending or twisting effects, etc. One of ordinary skill in the art would appreciate that there are numerous materials that a hazard detector could be built from and embodiments of the present invention are contemplated for use with any such materials.

In certain embodiments, the hazard detection means may be external from the hazard detector and may be communicatively connected to the hazard detector via one or more communications means (e.g., wired communications means, wireless communications means). In this manner, the hazard detector may be extendable with additional hazard sensors as required by the user or the specific implementation.

By allowing for a hazard detector that can not only detect local hazards, but also receive information about hazards in the area, individuals are provided with a safety device that increases the accuracy and reduces false positives when it comes to hazard alerts. Further, usage of embodiments of the present invention has the distinct advantage of providing constant access to emergency broadcast message, even when other devices would be powered off or otherwise not available.

Certain embodiments of the present invention may allow users or individuals near the hazard detector to communicate through the hazard detector with one or more remote hazard detection and alert systems. For instance, a hazard detector may have a built-in microphone for receiving voice commands from a user. In other embodiments, users may be able to connect to the hazard detector via wireless means (e.g., through a smartphone application or through a near field communication or Bluetooth connection means). In these embodiments, users have the ability to request help or otherwise provide more information about a hazard to the remote hazard detection and alert system. This may allow the remote hazard detection and alert system to contact the appropriate emergency personnel or issue a wider hazard alert for others in the immediate area.

Certain embodiments of the present invention may allow the user to interact with the hazard detector through a control interface connected to the hazard detector through one or more wireless connections, through one or more wired connections or any combination thereof. Control interfaces can include, but are not limited to, proprietary control panels, smart interfaces associated with other systems (e.g., thermostat interface, security panel interface, computer interface). Control interfaces may allow for the user to interact with the system in numerous ways, including, but not limited to, reporting a hazard, disarming a sensor, adding a sensor, removing a sensor, requesting aid (e.g., fire, rescue, medical), checking system status, checking power status (e.g., battery levels) or any combination thereof. One of ordinary skill in the art would appreciate that there are numerous types of interactions the system could provide to the user via a control interface, and embodiments of the present invention are contemplated for use with any type of interaction. Installation of the control interface could be anywhere that the control interface could be in communicatively connected to the hazard detector and usable by the user when required. Control interfaces may be interacted with via one or more interaction means, including, but not limited to, touchscreens, keyboards, buttons, optical devices, voice recognition means, switches, sliders or any combination thereof. One of ordinary skill in the art would appreciate that there are numerous interaction means that could be utilized with embodiments of the present invention and embodiments of the present invention are contemplated for use with any interaction means.

Figure 3:
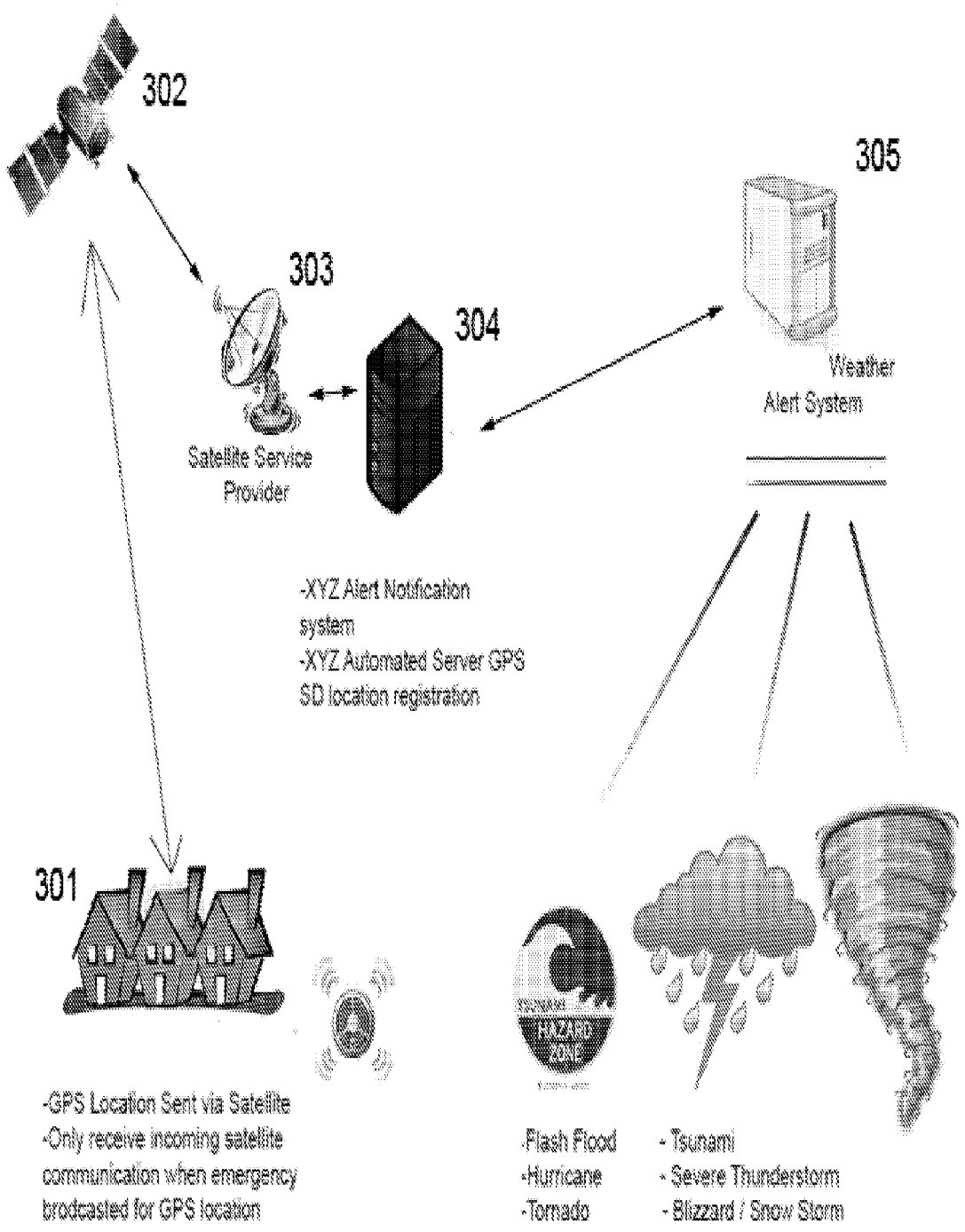
FIG. 3 is an overview of a system in accordance with an embodiment of the present invention.

Turning now to FIG. 3, an overview of a system in accordance with an embodiment of the present invention is shown. In this system diagram, one or more hazard detectors 301 communicate with a remote hazard detection and alert system 304 via a wireless communications means 302/303 (in this case a satellite communication means). The remote hazard detection and alert system 304 is communicatively connected with a third party alert system 305 (in this case a weather alert system, like NOAA).

According to an embodiment of the present invention, the remote hazard detection and alert system 304 is configured to receive and transmit hazard information 304 to one or more hazard detectors 301 based on a location identified by each of the hazard detectors 301. The actual hazard alerts may be formulated or drawn from one or more sources. In a preferred embodiment, the remote hazard detection and alert system 304 will pull alert information from a third-party system 305, generally from a application programming interface (API) or other information transmission service that is generally available. In other embodiments, the remote hazard detection and alert system 304 may generate its own alerts based on information collected from one or more hazard detectors 301. For instance, if numerous hazard detectors 301 in a specific geographic area are sending similar hazard identification information (e.g., smoke, heat), the remote hazard detection and alert system 304 could send alerts to all hazard detectors 301 in the immediate geographic location where the other hazard detectors sense the danger.

Figure 4:
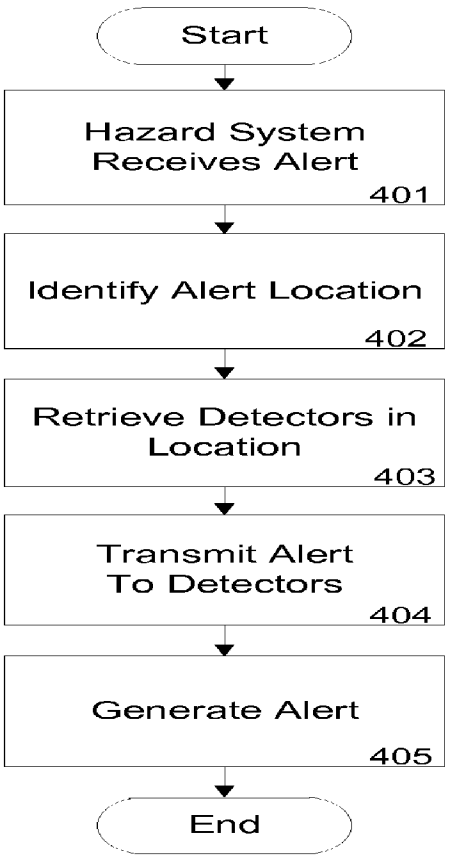
FIG. 4 is a process flow diagram for providing hazard alerts, in accordance with an embodiment of the present invention.

Turning now to FIG. 4, an exemplary method for providing hazard system alerts to one or more hazard detectors, in accordance with an embodiment of the present invention, is shown. The process starts at step 401 whereby a remote hazard detection and alert system receives a hazard alert from a third party alert system. In certain embodiments, the remote hazard detection and alert system may be configured to continually poll for hazard alerts of one or more types. In other embodiments, the remote hazard detection and alert system may be configured to receive hazard alerts from the third party alert system in a push manner (e.g., remote hazard detection and alert system automatically receives a communication from the third party alert system).

At step 402, the remote hazard detection and alert system parses the various information points received from the third party alert system, including geographic location of the alert, type of alert, impact area of the alert and severity of the alert as well as any secondary information associated with the alert. The remote hazard detection and alert system specifically details the area affected by the alert so that boundaries of which hazard detectors need to be contacted in response to a given alert.

At step 403, the remote hazard detection and alert system retrieves a list of one or more hazard detectors from a database or other data store. The list comprises only those hazard detectors either in the area or path of a given alert or those so proximately close to the area or path that either the direct impact of the hazard could cause repercussions on those outside the area or path or the hazard may have secondary effects that warrant alerting those outside the area or path of the hazard. For instance, an explosion of a nuclear reactor may have a direct blast, explosion and/or fire risk for a given area, but a secondary area may also be in risk of fallout or other secondary hazard concerns.

At step 404, the remote hazard detection and alert system sends the appropriate alerts to those hazard detectors identified in the list generated in the previous step. Alerts may vary on the type of hazard detector receiving the alert. For instance, a simple embodiment may only have an audible alert means, allowing the hazard detector to beep loudly in response to the receipt of an alert. In a more complex embodiment, the audible alert means may be comprised of an audible alert means capable of playing an alert message and alert information.

At step 405, each of the hazard detectors receiving the alerts utilize their respective alert means to alert the individuals in the nearby area of the impending or present hazard. At this point, the process ends.

Figure 5:
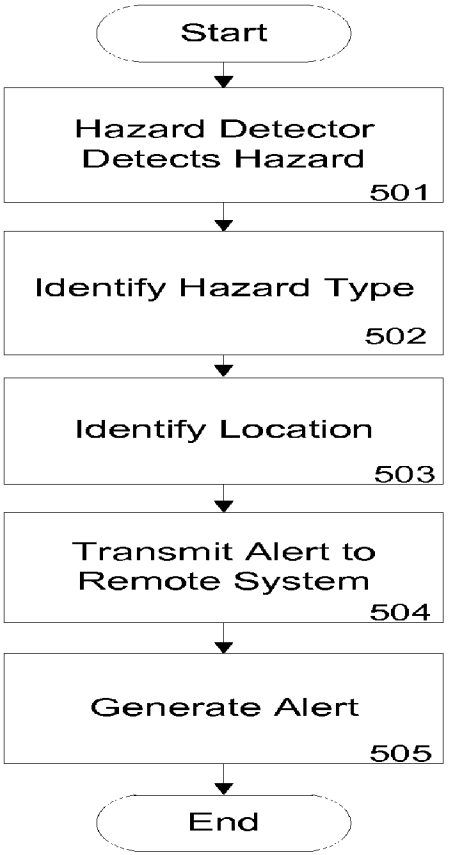
FIG. 5 is a process flow diagram for providing hazard reporting from a hazard detector, in accordance with an embodiment of the present invention.

Turning now to FIG. 5, an exemplary method for providing hazard reporting from a hazard detector, in accordance with an embodiment of the present invention, is shown. The process starts at step 501 whereby one or more hazard detectors detect the presence of a hazard via one or more hazard detection means. The more hazard detection means alerted, the greater level of information about the hazard could be identified. For instance, if a smoke detection is set off, it would provide hints at a nearby fire, but a smoke detection means and a heat detection means are both set off, the likelihood of a fire in the area is shown with greater certainty.

At step 502, the hazard detector identifies what kind of hazard is in the area by accumulating data from any and all hazard detection means that have been tripped or otherwise alerted to the presence of a hazard. In certain embodiments, hazard detection means that were not set off may be turned on to record or test for other hazards. For instance, a hazard detector that has a smoke sensor alerted to the presence of smoke may turn on an attached camera to record visual information that may be later processed by either the hazard detector or a remote hazard detection and alert system.

At step 503, the hazard detector may confirm its present location. In some cases, this step may be skipped where the hazard detector is known to be immobile or otherwise preprogrammed for a specific location. In certain embodiments, if the hazard detector cannot identify its location, it may use a last known location as its location. This helps to prevent loss of signal with its geolocation means disabling the ability of the hazard detector from reporting the hazard.

At step 504, The hazard detector transmits the alert information to a remote hazard detection and alert system for processing. The remote hazard detection and alert system takes the alert information and takes appropriate action with respect to the type and severity of alert. Actions may include contacting the appropriate response personnel (e.g., medical, rescue, fire, police), contacting specified individuals (e.g., home owner, parent, guardian), contacting a third party alert system (e.g., NOAA) to report a potential hazard. In cases where numerous hazard detectors report alerts of the same type or similar or related types, the remote hazard detection and alert system may also generate an alert and push the alert to other hazard detectors in the general area.

At step 505, the hazard detector may generate a local alert for individuals in the area. At this point, the process ends.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a finite sequence of computational instructions or program instructions. It will be appreciated that a programmable apparatus (i.e., computing device) can receive such a computer program and, by processing the computational instructions thereof, produce a further technical effect.

A programmable apparatus includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

In view of the foregoing, it will now be appreciated that elements of the block diagrams and flowchart illustrations support combinations of means for performing the specified functions, combinations of steps for performing the specified functions, program instruction means for performing the specified functions, and so on.

It will be appreciated that computer program instructions may include computer executable code. A variety of languages for expressing computer program instructions are possible, including without limitation C, C++, Java, JavaScript, assembly language, Lisp, HTML, and so on. Such languages may include assembly languages, hardware description languages, database programming languages, functional programming languages, imperative programming languages, and so on. In some embodiments, computer program instructions can be stored, compiled, or interpreted to run on a computer, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computer enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computer can process these threads based on priority or any other order based on instructions provided in the program code.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A hazard detector system, comprising:

a hazard detector communicatively connected to one or more computing devices, said hazard detector comprising:

a power source;

a plurality of hazard detection devices that are each different, each hazard detection device detecting a hazardous environmental condition different from that detected by another hazard detection device, wherein said plurality of hazard detection devices include at least a first hazard detection device that is a smoke and/or a carbon monoxide detector, a second hazard detection device that is a heat detector, a third hazard detection device that is a water sensor, and a fourth hazard detection device that is a seismic detector, wherein said plurality of hazard detection devices are configured to transmit information related to a plurality of hazardous environmental conditions to and from said one or more computing devices, wherein said plurality of hazardous environmental conditions comprise smoke, carbon monoxide, heat, seismic events, and water;

an alert device configured to provide a perceptible alert to individuals in proximity to the hazard detector;

a geolocation device configured to identify the geographic location of the hazard detector;

a secondary location component comprising one or more of an accelerometer, a level device, an anemometer or an altimeter; and a control interface incorporating an interaction device selected from the group comprising a keyboard, a touchscreen, and a voice recognition device; wherein said control interface provides said individuals in proximity of the hazard detector the ability to provide additional information about said hazardous environmental conditions by interacting with said interaction device of said control interface, including providing confirmation of the existence of said hazardous environmental conditions, wherein the control interface further allows for individuals in proximity of the hazard detector to cause the hazard detector to perform a plurality of actions selected from the group comprising: disarming one of said plurality of hazard detection devices, adding a hazard detection device to said plurality of hazard detection devices, removing a hazard detection device from said plurality of hazard detection devices, requesting aid, checking status of said hazard detector, and checking status of said power source;

wherein at least one of said one or more computing devices is a hazard detection and alert system configured to receive hazard information from and transmit hazard information to one or more hazard detectors based on the location of the one or more hazard detectors, wherein said hazard detection and alert system is communicatively connected to a third party system that provides environmental hazard information, and is configured to receive information from said third party system; and wherein said power source, said plurality of hazard detection devices, said alert device, said geolocation device, said secondary location component, and said control interface, are communicatively connected to one or more computing devices and are contained in, or connected to, the same portable hazard detector unit.

2. The hazard detector system of claim 1, wherein said alert device is selected from the group comprising, speakers, video displays, LEDs, warning lights, strobe lights, force feedback devices, electro stimulation devices and tone generators.

3. The hazard detector system of claim 1, further comprising one or more power sources selected from the group comprising an AC power source, a DC power source, a battery powered power source, and a solar power source.

4. The hazard detector system of claim 1, wherein said plurality of hazard detection devices are selected from the group of devices consisting of: said smoke detector, said carbon monoxide detector, said heat detector, a motion sensor, a video camera, a glass break sensor, a microphone, a seismic detector, a Geiger counter, and said water sensor.

5. The hazard detection system of claim 1, wherein said remote hazard detection and alert system contains data identifying alert device types present in each of said one or more hazard detectors and transmits warnings to said one or more hazard detectors based on said alert device types.

6. The hazard detector system of claim 1, further comprising at least one visually perceptible alert and/or at least one audibly perceptible alert configured to provide alerts in sequence(s) to inform the individual(s) in the proximity of the type, nature, or severity of the hazardous environmental condition(s).

7. The hazard detector system of claim 6, wherein the alert comprises at least one visually perceptible alert means of different color(s), sequences, and luminous intensity based on said hazard alert type, nature, or severity of the hazardous environmental condition(s) and/or at least one audibly perceptible alert of varying decibel intensity based on said hazard alert type, nature, or severity of the hazardous environmental condition(s).

* * * * *